US006817491B2

(12) United States Patent
Suzuki

(10) Patent No.: US 6,817,491 B2
(45) Date of Patent: Nov. 16, 2004

(54) DISCHARGE CONTAINER

(75) Inventor: Takashi Suzuki, Tokyo (JP)

(73) Assignee: Kabushiki Kaisha Top, Tokyo (JP)

( * ) Notice: Subject to any disclaimer, the term of this patent is extended or adjusted under 35 U.S.C. 154(b) by 0 days.

(21) Appl. No.: 10/332,066

(22) PCT Filed: Jun. 28, 2001

(86) PCT No.: PCT/JP01/05573

§ 371 (c)(1),
(2), (4) Date: Mar. 3, 2003

(87) PCT Pub. No.: WO02/02241

PCT Pub. Date: Jan. 10, 2002

(65) Prior Publication Data

US 2004/0099694 A1 May 27, 2004

(30) Foreign Application Priority Data

Jul. 3, 2000 (JP) ..... 2000-201413

(51) Int. Cl.[7] ..... B65D 88/54
(52) U.S. Cl. ..... 222/321.9
(58) Field of Search ..... 222/321.2, 321.9, 222/340

(56) References Cited

U.S. PATENT DOCUMENTS 4,053,089 A 10/1977 Gamadia

FOREIGN PATENT DOCUMENTS

JP 51-6361 2/1976

*Primary Examiner*—Philippe Derakshani
(74) *Attorney, Agent, or Firm*—Birch, Stewart, Kolasch & Birch, LLP

(57) ABSTRACT

A discharge container capable of discharging a liquid in a stable state. In a pump portion of the discharge container, when pressing down a first piston, a second piston is pressed down by a drug solution charged within a cylinder and a second spring is compressed. When a front end portion of the first piston passes through a step portion of the cylinder, an outflow port and an inner portion of the cylinder communicate with each other. The drug solution charged within the cylinder is pressed out by the second piston by an urging force of the second spring and flows out from the outflow port. Since the drug solution is discharged by a uniform force due to the force of the second spring, when the drug solution is discharged in a vapor form, a fixed spraying state is always obtained.

5 Claims, 10 Drawing Sheets

6
7
2
8
9
11
13
14
15
16
17
21

6
8
7a
7b
10
2
17
21
13
11
9
18
15
16

BACKGROUND ART

DISCHARGE CONTAINER

This application is the national phase under 35 U.S.C. §371 of PCT International Application No. PCT/JP01/05573 which has an International filing date of Jun. 28, 2001, which designated the United States of America.

TECHNICAL FIELD

The present invention relates to a discharge container which receives a liquid such as a drug solution or the like, and discharges the liquid on the basis of a pump operation.

BACKGROUND ART

A pump portion 41 used for a conventional discharge container for discharging a liquid such as a drug solution or the like is provided, as shown in FIG. 10A, with a cylinder 42 filled with a drug solution 2, a piston provided within the cylinder 42 so as to freely oscillate and urged upward by a spring 43, and an outflow valve 45 formed by a flexible member, brought into contact with an outer peripheral portion of the piston 44 and oscillating within the cylinder 42 together with the piston 44. Further, the cylinder 42 is provided in a bottom portion with an inflow port 46 flowing the liquid into the cylinder 42 from a container (not shown) receiving the liquid, and a check ball 47 corresponding to an inflow valve passing the liquid flowed within the cylinder 42 and shutting the liquid supplied from the above. In the discharge container having the pump portion 41 in, accordance with the conventional art, when a user presses down the piston 44, the piston 44 and the outflow valve 45 are integrally pressed downward as shown in FIG. 10B, whereby a pressure is applied to the liquid within the cylinder 42. Since the check ball 47 provided in the bottom portion of the cylinder 42 shuts the liquid from the supplied from the above, the pressure is applied to the liquid within the cylinder 42. As mentioned above, when the pressure is applied to the liquid within the cylinder 42, the outflow valve 45 in an outer peripheral portion of the piston 44 is bent, whereby the liquid is flowed out upward from a gap between the outflow valve 45 and the piston 44.

Further, when the user takes off a hand from the piston 44, the piston 44 is pressed upward by the spring 43. At this time, the piston 44 and the outflow valve 45 are brought into contact with each other, whereby the outflow valve 45 is closed, so that the drug solution is sucked from the inflow port 46 via the check ball 47 so as to be charged within the cylinder 42.

In the conventional discharge container mentioned above, a state that the liquid is discharged is changed in correspondence to a speed at which the user presses the piston 44. For example, when the speed at which the piston 44 is pressed is high, the liquid is energetically discharged, however, when the speed at which the piston 44 is pressed is low, the liquid is discharged only little by little. Accordingly, for example, in the case that the discharge container is used as a spray for atomizing the drug solution in a vapor form, the drug solution is discharged in a vapor form if the speed at which the piston 44 is pressed is high, however, the drug solution is discharged in a liquid ball form not in a vapor form if the speed at which the piston 44 is pressed is low. In the case that the discharge container is used as the spray for applying the drug solution as mentioned above, since a diameter of an applied drop of the drug solution is changed in correspondence to a pressing way of the piston 44, there is a risk that a result of effect due to the drug application is changed.

Further, in the conventional discharge container mentioned above, since generally the discharge port for discharging the liquid and the piston 44 are integrally formed, the discharge port is pressed down when the piston 44 is pressed down. Accordingly, in the conventional discharge container, when discharging the liquid, the discharge port discharges the solution while moving down. Accordingly, even in the case that it is necessary for the user to discharge the liquid to an accurate position, the discharge port moves, so that it is hard to discharge to the accurate position.

An object of the present invention is to improve a discharge container, and further in order to solve the problem mentioned above, a detail object is to provide a discharge container which can discharge a liquid such as a drug solution or the like in a stable state.

DISCLOSURE OF THE INVENTION

In order to achieve the object mentioned above, in accordance with a first aspect of the present invention, there is provided a discharge container for discharging a liquid received within a container to an external portion on the basis of a pump operation, having the following features. At first, the discharge container is provided with a cylinder within which a liquid is charged, a first piston slidably provided within the cylinder and urged in a backward moving direction by a first spring, a second piston slidably provided within the cylinder and backward moving while compressing a second spring when the liquid within the cylinder is pressed by the first piston, an inflow port for flowing the liquid from the inner portion of the container to an inner portion of the cylinder, an inflow valve provided between the inflow port and the container, passing the liquid flowing into the cylinder and shutting an outflow of the liquid from the inner portion of the cylinder, an outflow port for flowing the liquid to the external portion from the inner portion of the cylinder, and a liquid passage connecting the outflow port to the discharge port.

Further, the cylinder has a small diameter portion having a small inner diameter, a large diameter portion having a large inner diameter and a step portion corresponding to a boundary therebetween, the first piston is provided within the small diameter portion, the second piston is provided within the large diameter portion so as to oppose to the first piston, the outflow port is formed near a front end portion of the first piston so as to direct to a sliding surface with the cylinder, the liquid passage is connected to the discharge port through the first piston, the inflow port is provided so as to pass through the second piston, the first piston is urged in a direction moving apart from the second piston by the first spring, the second piston is urged by the second spring so as to be brought into contact with the step portion.

Further, while the first piston moves at a predetermined stroke, the outflow port is closed, and the second piston moves backward while pressing and compressing the second spring by the liquid existing between the first piston and the second piston.

On the other hand, when the first piston moves over the predetermined stroke, the outflow port is opened, the second piston is pressed back to the second spring and the liquid within the cylinder is discharged to the external portion via the outflow port, the liquid passage and the discharge port due to an urging force of the second spring.

In the discharge container in accordance with the first aspect of the present invention, in the case that the first piston is pressed by the user, since the outflow port is closed until the predetermined stroke, the pressure is applied to the liquid received between the first piston and the second piston, the second spring is compressed and the second piston moves backward. Further, when the first piston is pressed over the predetermined stroke, the outflow port is opened, so that the liquid to which the pressure is applied from the second spring flows out from the outflow port, and the liquid is discharged to the external portion via the liquid passage and the discharge port.

As mentioned above, in the discharge container in accordance with the first aspect of the present invention, the liquid within the cylinder is urged by the second spring so as to be discharged. Therefore, in accordance with the discharge container of the present invention, since the pressure applied to the liquid at a time of discharging the liquid becomes uniform, it is possible to always discharge in a stable state. Accordingly, even in the case that the discharge container in accordance with the present invention is used in the spray for spraying the drug solution, since the state of the sprayed drug solution is stable, a diameter of an applied drop of the drug solution is not changed, and a result of effect due to the drug application becomes uniform. Further, in the case that the user presses the first piston, the liquid is not discharged until the predetermined stroke and the liquid is discharged when being over the predetermined stroke. Accordingly, when the outflow port is connected to the first piston, a moving amount of the discharge port at a time when the liquid is discharged from the discharge port becomes a little, so that the user can discharge the liquid to an accurate position.

Further, as shown in FIG. 3, the structure may be made such that the cylinder is constituted by an outer cylinder formed in a cylindrical body having a bottom, and an inner cylinder provided within the outer cylinder and having a bottom portion communicated with the outer cylinder via a communication portion, the first piston is formed in a cylindrical shape and outward fitted to the inner cylinder, a lower end portion of the first piston is slidably in contact with an inner peripheral surface of the outer cylinder and an outer peripheral surface of the inner cylinder, the second piston is provided within the inner cylinder, the liquid passage is formed in a gap between an inner peripheral surface above the lower end portion of the first piston and the outer peripheral surface of the inner cylinder, the outflow port is formed between the inner peripheral surface of the first piston and the communication portion in a state that the lower end portion of the first piston passes through the communication portion, the inflow port is provided in the bottom portion of the inner cylinder, the first piston is urged in a direction moving apart from the bottom portion of the outer cylinder by the first spring, the second piston is urged toward the bottom portion of the inner cylinder by the second spring, and when the first piston moves over the predetermined stroke, the lower end portion of the first piston moves over the communication portion and the outflow port is opened.

Further, as shown in FIG. 5, the structure may be made such that the cylinder is constituted by an outer cylinder formed in a cylindrical body having a bottom, and an inner cylinder formed on an inner peripheral surface of a cylindrical second piston provided within the outer cylinder, the second piston is slidably in contact with an inner peripheral surface of the outer cylinder and having a bottom surface portion facing to the liquid within the cylinder, the first piston is provided within the inner cylinder, a lower end portion of the first piston is slidably in contact with an inner peripheral surface of the inner cylinder toward a bottom surface of the outer cylinder, the liquid passage is formed above the lower end portion with a gap with respect to the inner peripheral surface of the inner cylinder, the outflow port is formed between the bottom surface portion of the second piston and the lower end portion of the first piston in a state that the lower end portion of the first piston protrudes out from the bottom surface portion of the second piston, the inflow port is provided in the bottom surface of the outer cylinder, the first piston is urged in a direction moving apart from the bottom portion of the outer cylinder by the first spring, the second piston is urged toward the bottom portion of the outer cylinder, and when the first piston moves over the predetermined stroke, the lower end portion of the first piston moves over the bottom surface portion of the second piston and the outflow port is opened.

Further, as shown in FIG. 7, the structure may be made such that the cylinder is formed in a cylindrical shape, the first piston and the second piston are provided within the cylinder so as to oppose to each other, the outflow port is open to a side surface of the cylinder corresponding to a part of a stroke of the second piston, the inflow port is provided so as to extend through the second piston, the first piston is urged in a direction moving apart from the second piston by the first spring, the second piston is urged toward the first piston by the second spring, while the first piston moves to the predetermined stroke, the outflow port is closed by a side surface of the second piston, and when the first piston moves over the predetermined stroke, the second piston is pressed, an end portion in a side of the first piston moves over the outflow port and the outflow port is opened.

Further, a discharge container in accordance with a second aspect of the present invention is provided with the following features. At first, there is provided a discharge container for discharging a liquid received within a container to an external portion from a discharge port on the basis of a pump operation, provided with a case with a bottom held in the container, a first piston provided on a bottom surface of the case, a cylinder outward fitted to the first piston within the case and filled with a liquid therewithin, a second piston provided within the cylinder with a predetermined gap with respect to the first piston, a first spring urging the cylinder upward, a second spring urging the second piston to a side of the first piston, an inflow port extending through the first piston so as to flow the liquid from the container into the cylinder, an inflow valve provided between the inflow port and the container so as to pass the liquid flowing into the cylinder and prevent the liquid from flowing out from the inner portion of the cylinder, an outflow valve urged to an upper surface of the second piston by the second spring so as to be brought into contact therewith, having an outer peripheral portion protruding from an outer peripheral edge of the second piston so as to be slidably brought into contact with an inner peripheral surface of the cylinder and having a portion protruding out from the outer peripheral edge of the second piston and facing to the liquid within the cylinder, an outflow port formed in a contact portion between the outflow valve and the second piston and flowing out the liquid to an external portion from an inner portion of the cylinder, a liquid passage connecting the outflow port to the discharge port, and a gap holding member arranged between an upper surface of the first piston and a lower surface of the second piston so as to keep a gap between the both.

Further, a recess portion to which the gap holding member can be inserted in a moving direction at a predetermined distance is provided on a surface of the second piston opposing to the first piston, and a guide portion for guiding the gap holding member to the recess portion when the cylinder is pressed down is provided in the cylinder.

The gap holding member is held by the first spring in a state of being out of the recess portion when the cylinder is not pressed down. When pressing downward the cylinder to the predetermined stroke, the gap holding member is brought into contact with the first piston and the second piston in a state of being out of the recess portion so as to press and compress the second spring while keeping a gap between the both. When pressing down the cylinder over the predetermined stroke, the gap holding member is guided by the guiding member so as to be inserted to the recess portion, and the gap holding member press down the second piston downward at a distance that the gap holding member is inserted to the recess portion by the second spring, thereby applying a pressure to the liquid within the cylinder. Then, the second spring is pressed and compressed by the pressure of the liquid, the outflow valve is opened so as to open the outflow port, and the liquid is flowed out to the external portion via the outflow port, the liquid passage and the discharge port.

In the discharge container in accordance with the second aspect of the present invention, the first piston is provided within the cylinder, and the second piston is provided therewithin at a position opposing to the first piston. Further, the gap holding member is arranged between the first piston and the second piston. Accordingly, in the case that the cylinder is pressed by the user, the first piston relatively moves within the cylinder until the predetermined stroke by the gap holding member while moving the second piston backward. Accordingly, the second spring is compressed by the second piston, however, since the gap between the first piston and the second piston is held by the gap holding member and is not changed, no pressure is applied to the liquid existing between the both.

Further, when the cylinder is pressed over the predetermined stroke, the gap holding member is inserted to the recess portion provided in the first piston or the second piston. Accordingly, the gap holding member keeping the gap between the first piston and the second piston is taken out from the portion between the both, and the second piston is pressed to the side of the first piston by the compressed second spring. Therefore, the pressure is applied to the liquid between the first piston and the second piston, and the outflow valve is opened, whereby the liquid within the cylinder is discharged to the external portion from the outflow port via the liquid passage and the discharge port.

As mentioned above, in the discharge container in accordance with the second aspect of the present invention, in the same manner as that of the first aspect, since the liquid within the cylinder is urged by the second spring so as to be discharged, the pressure applied to the liquid at a time of discharging the liquid becomes uniform, so that the liquid is always discharged in a stable state. Further, in the same manner as that of the first aspect, since the liquid is not discharged until the predetermined stroke and the liquid is discharged when being over the predetermined stroke, the user can discharge the liquid at an accurate position.

BEST MODE FOR CARRYING OUT THE INVENTION

Figure 1:
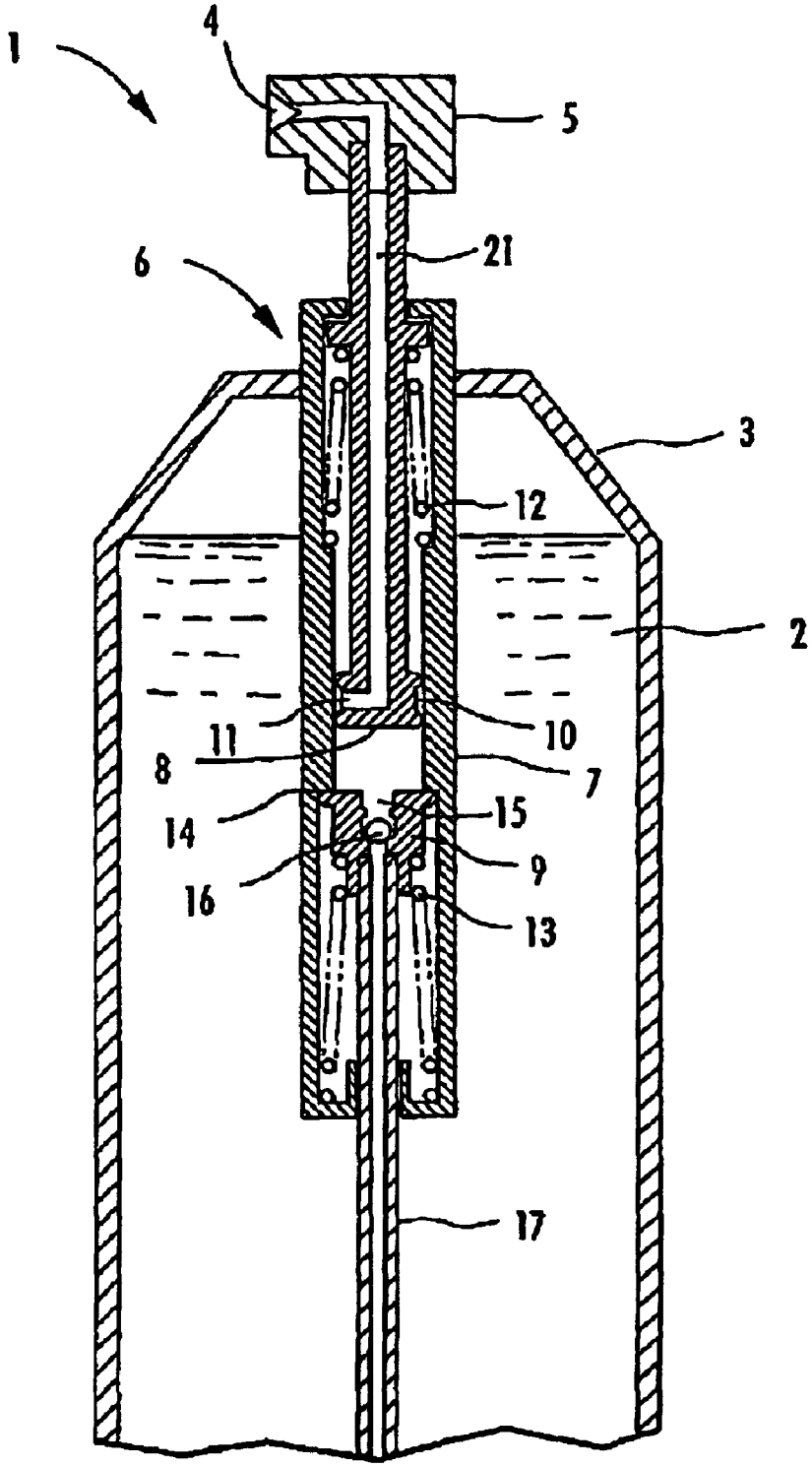
FIG. 1 is a schematic cross sectional view showing a first embodiment in a discharge container in accordance with a first aspect of the present invention.
Figures 2A, 2B, 2C, 2D:
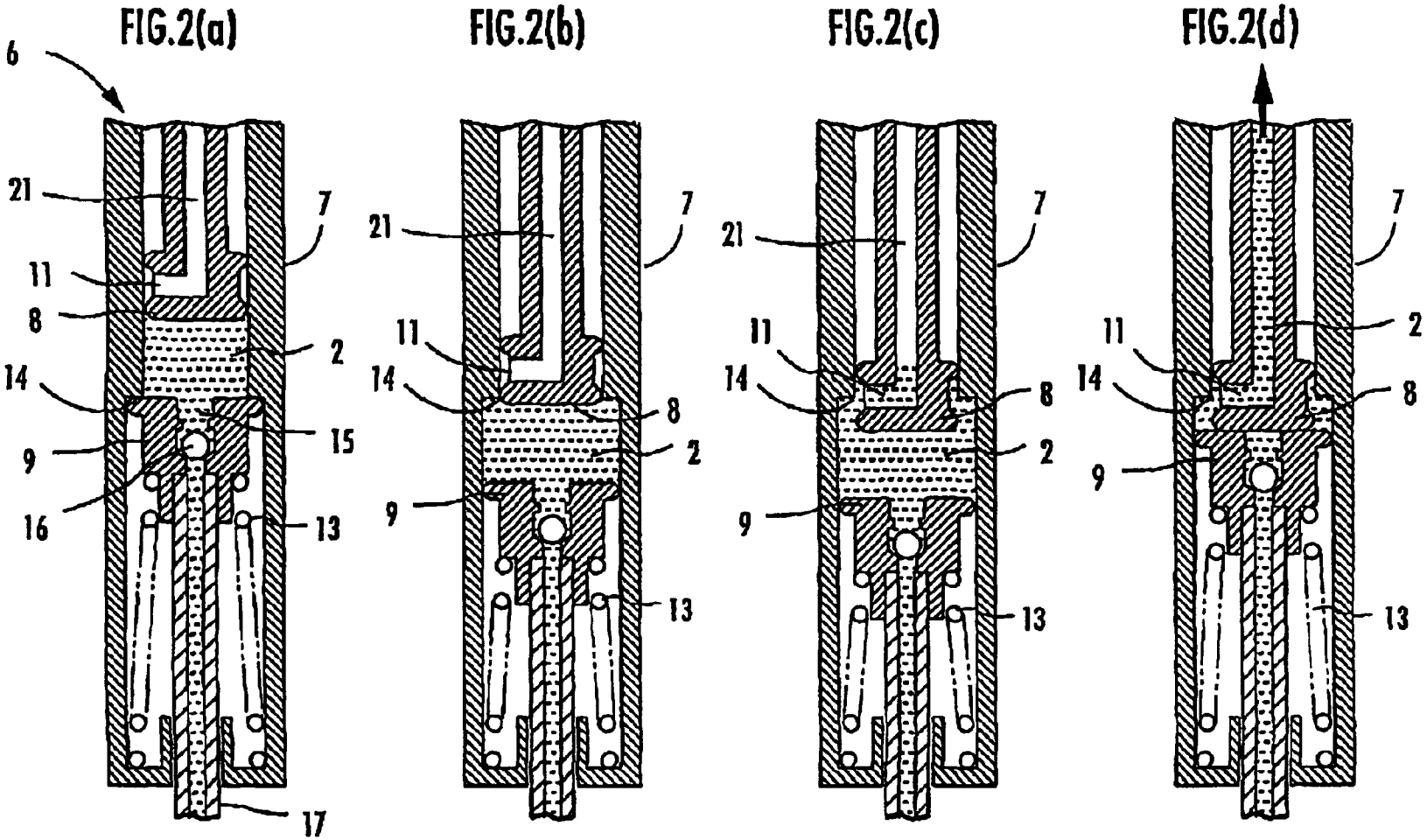
FIGS. 2A to 2D are schematic views showing an operation of a pump portion in accordance with the first embodiment.
Figure 3C:
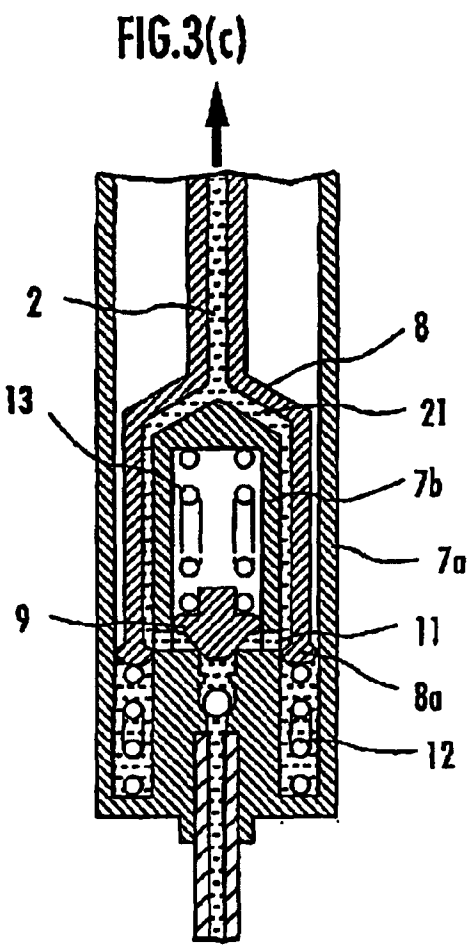
FIGS. 3A to 3C are schematic views showing an operation of a pump portion in accordance with a second embodiment.
Figure 3B:
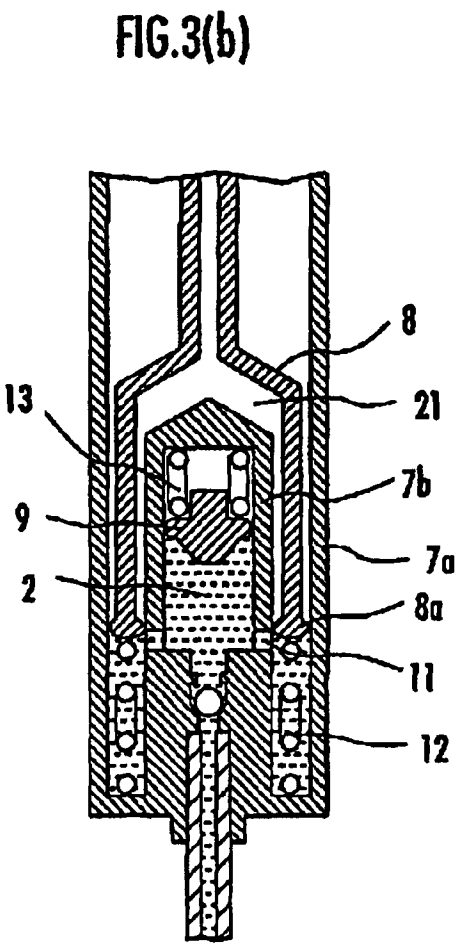
Figure 3A:
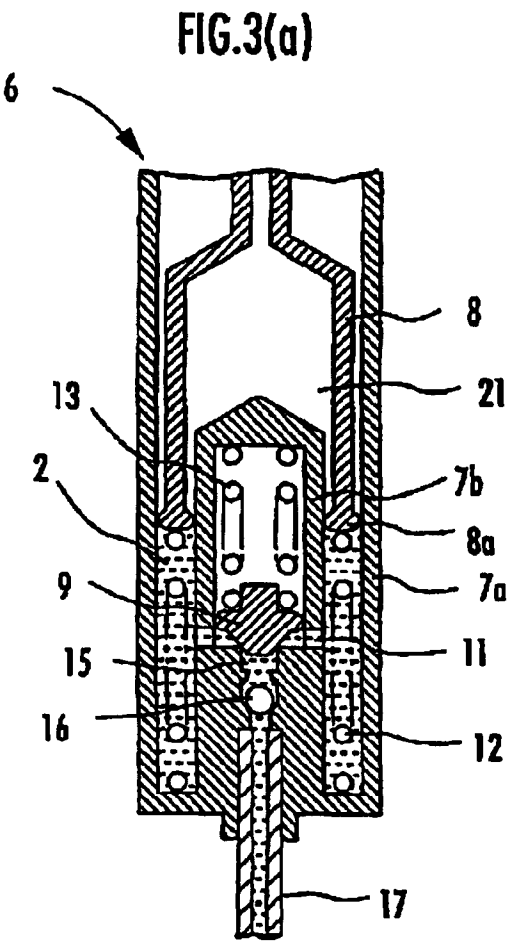
Figures 4A, 4B, 4C:
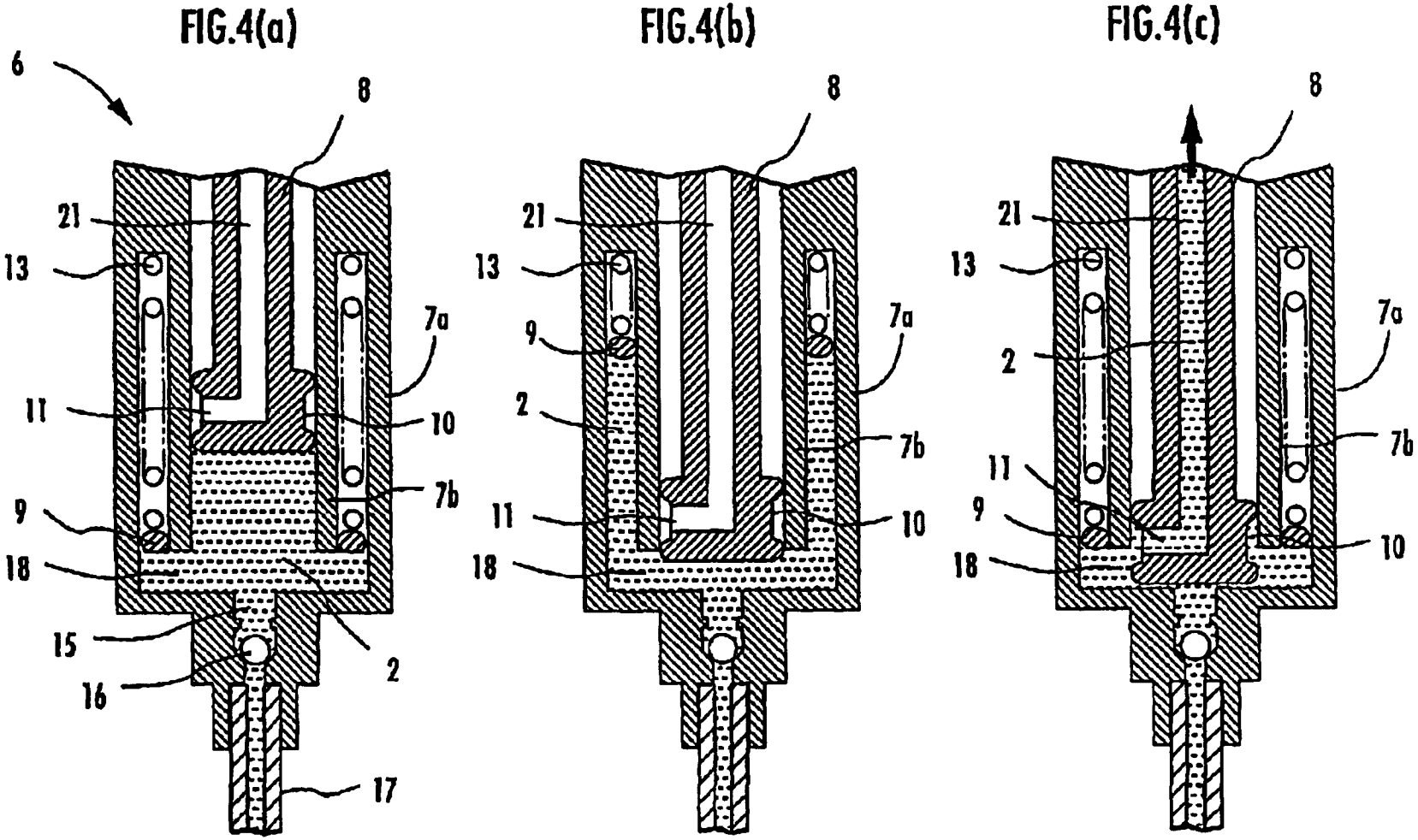
FIGS. 4A to 4C are schematic views showing an operation of a pump portion in accordance with a third embodiment.
Figure 5C:
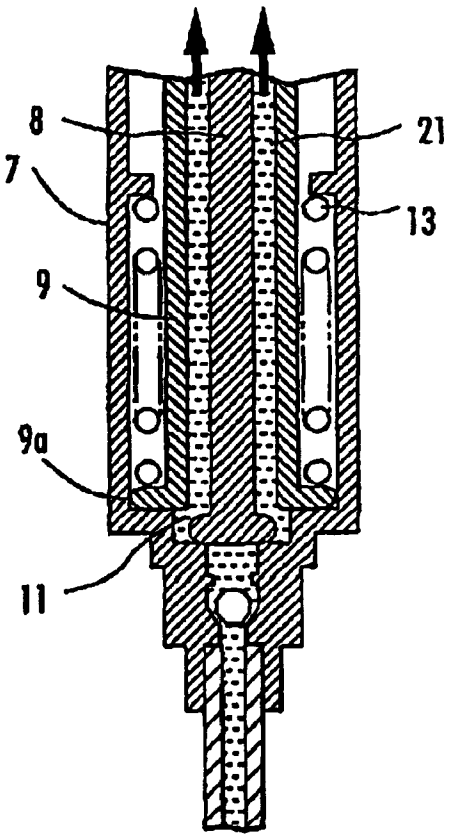
FIGS. 5A to 5C are schematic views showing an operation of a pump portion in accordance with a fourth embodiment.
Figure 5B:
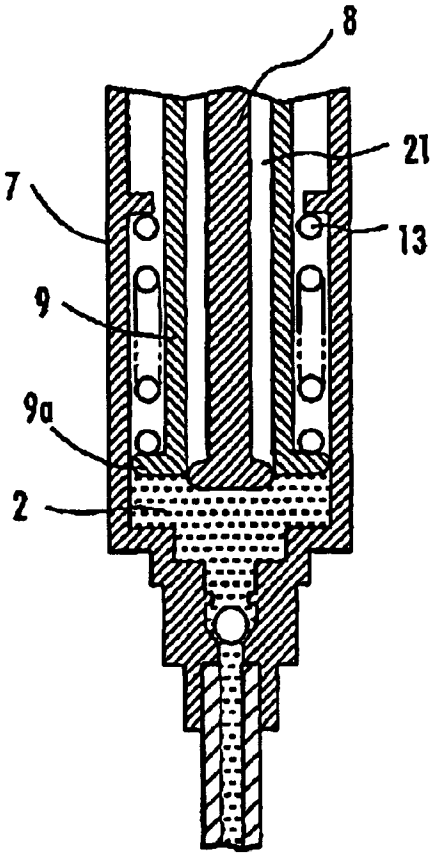
Figure 5A:
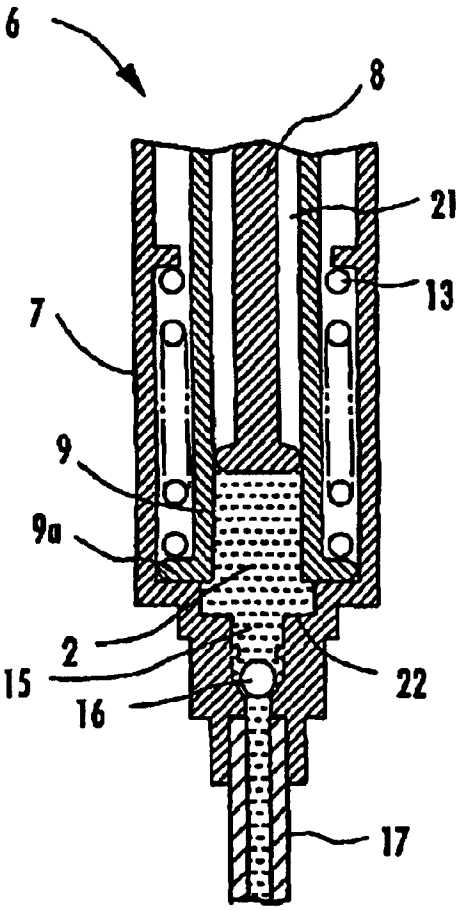
Figure 6:
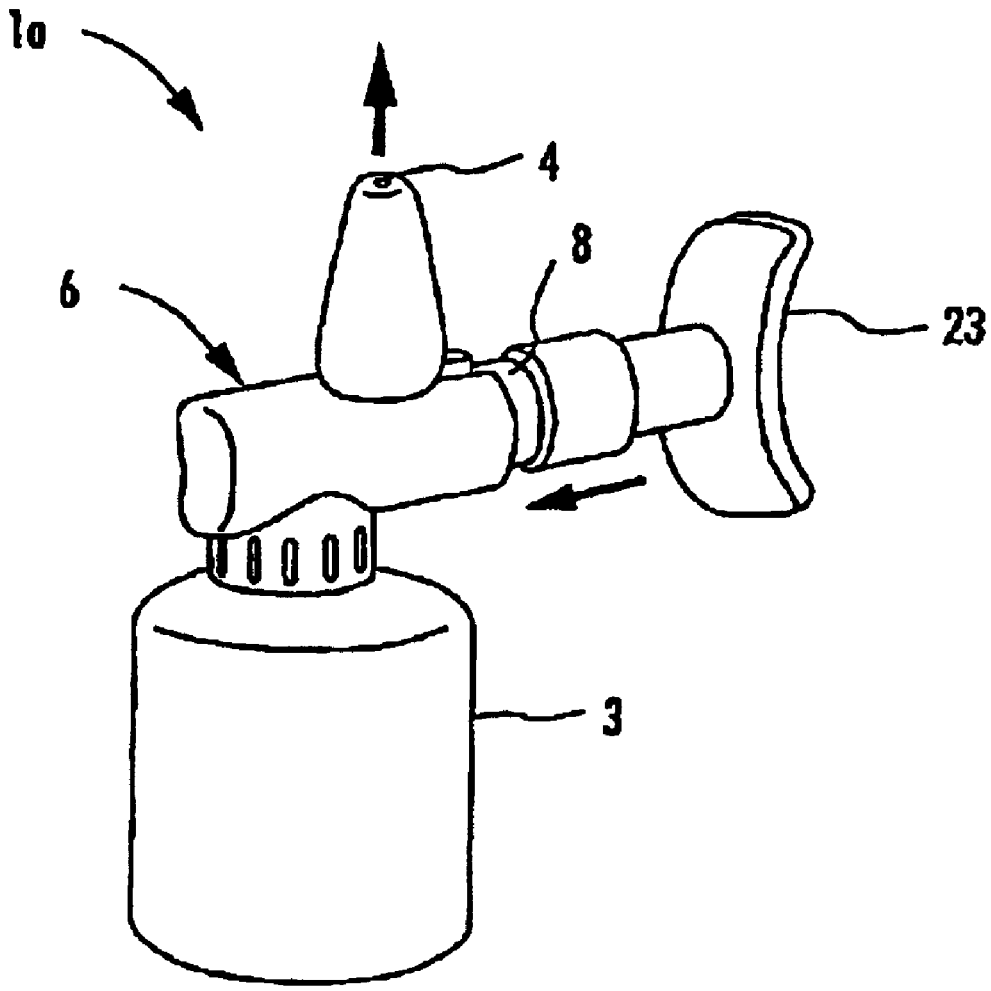
FIG. 6 is a schematic view showing a discharge container in accordance with a fifth embodiment.
Figure 7A:
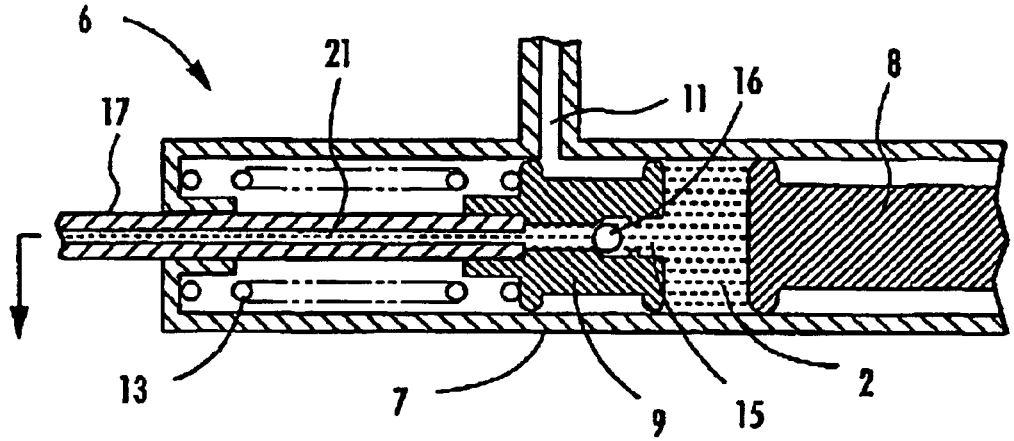
FIGS. 7A to 7C are schematic views showing an operation of a pump portion in accordance with the fifth embodiment.
Figure 7B:
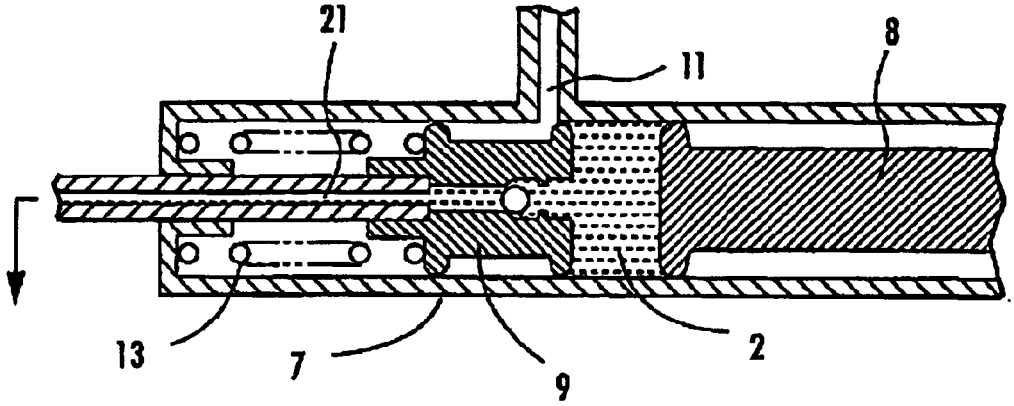
Figure 7C:
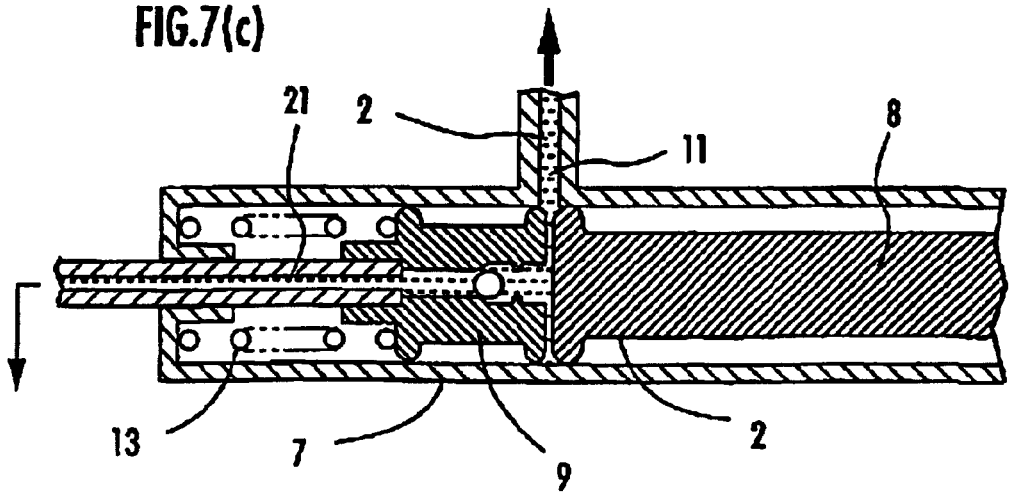
Figure 8:
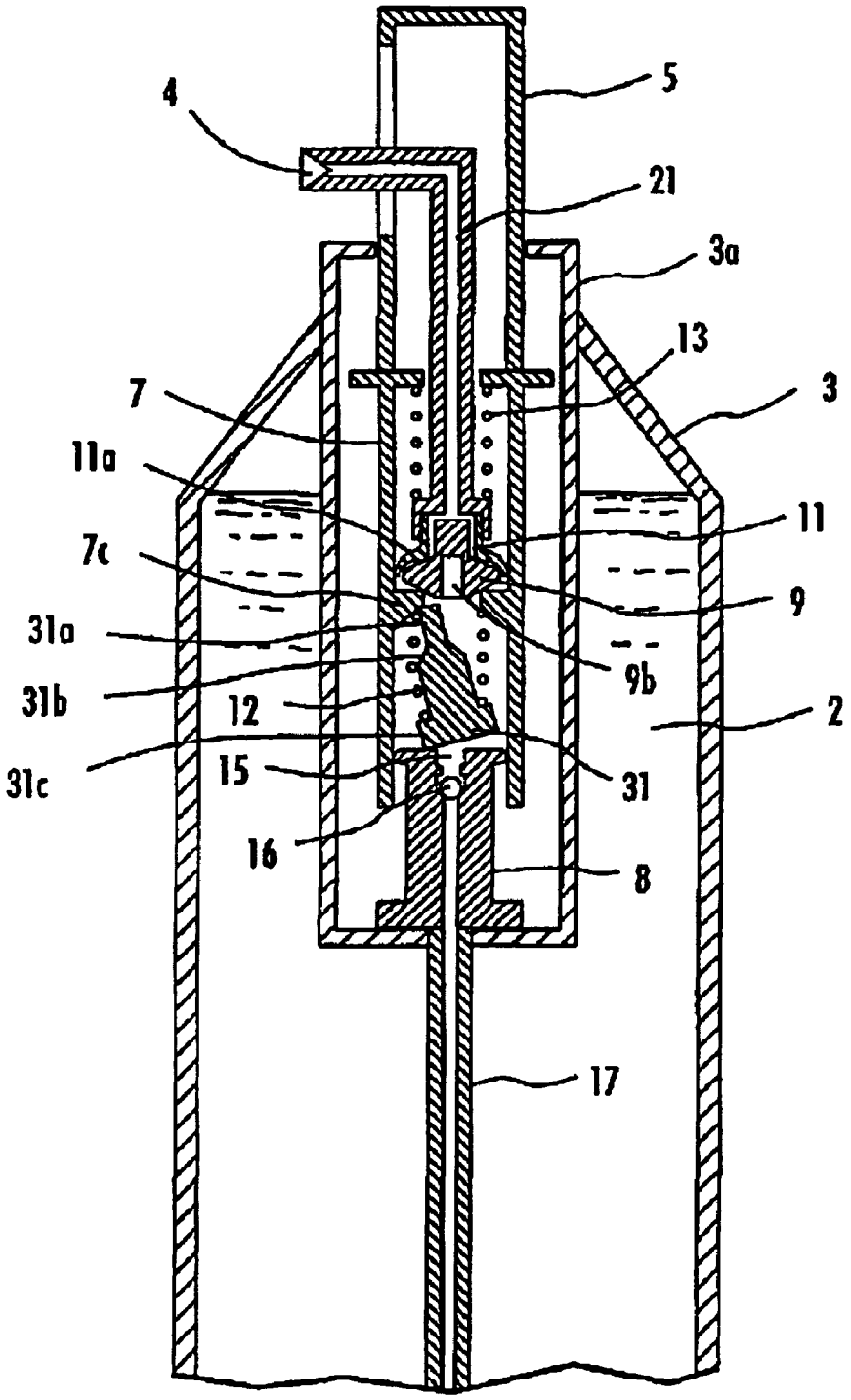
FIG. 8 is a schematic cross sectional view showing an embodiment of a discharge container in accordance with a second aspect of the present invention.
Figure 9C:
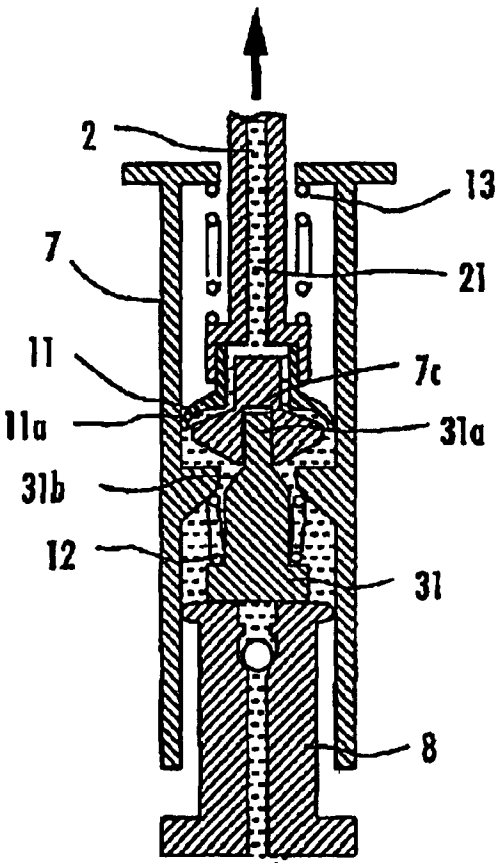
FIGS. 9A to 9C are schematic views showing an operation of a pump portion in accordance with the embodiment of the second aspect
Figure 9B:
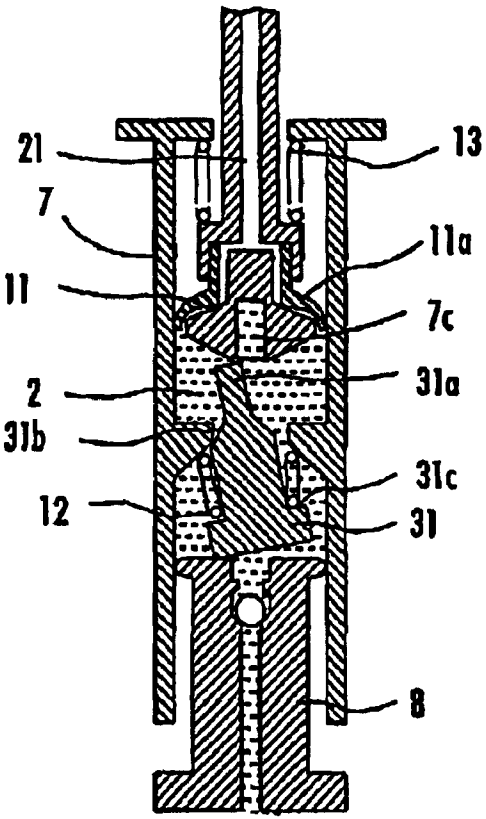
Figure 9A:
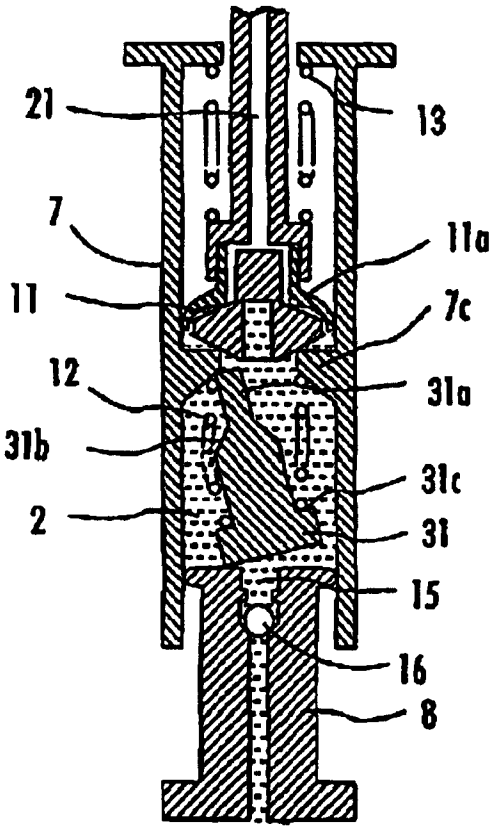
Figure 10A:
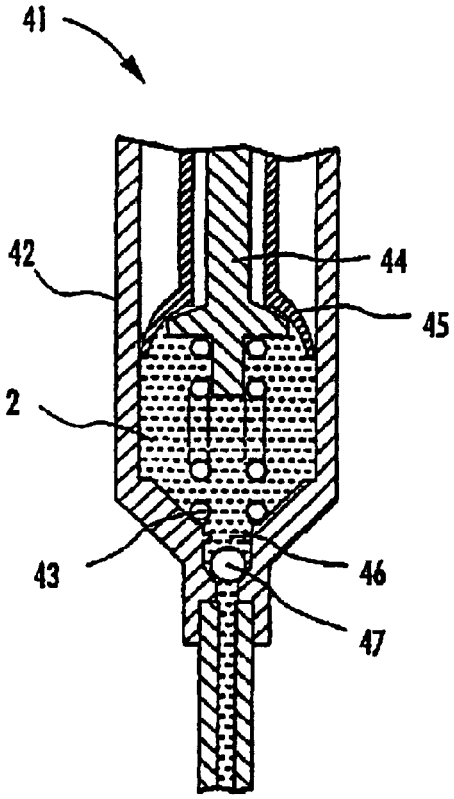
FIGS. 10A and 10B illustrate a conventional discharge container.
Figure 10B:
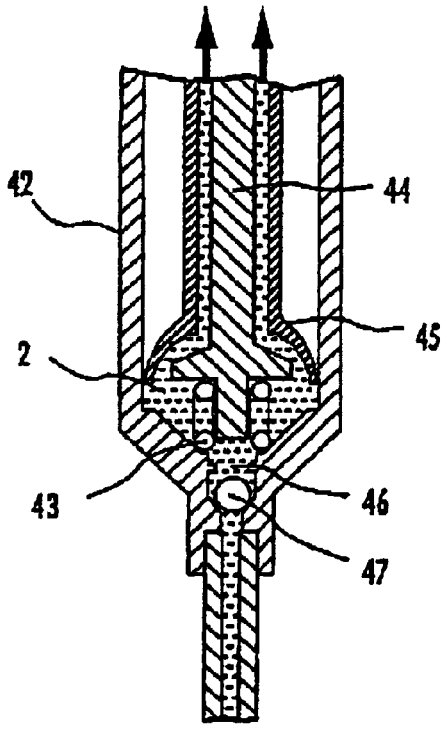
BACKGROUND ART FIG.10(b)

A description will be given below of an embodiment of a discharge container in accordance with the present invention with reference to FIGS. 1 to 9. FIG. 1 is a schematic cross sectional view showing a first embodiment in a discharge container in accordance with a first aspect of the present invention, FIGS. 2A to 2D are schematic views showing an operation of a pump portion in accordance with the first embodiment, FIGS. 3A to 3C are schematic views showing an operation of a pump portion in accordance with a second embodiment, FIGS. 4A to 4C are schematic views showing an operation of a pump portion in accordance with a third embodiment, FIGS. 5A to 5C are schematic views showing an operation of a pump portion in accordance with a fourth embodiment, FIG. 6 is a schematic view showing a discharge container in accordance with a fifth embodiment, FIGS. 7A to 7C are schematic views showing an operation of a pump portion in accordance with the fifth embodiment, FIG. 8 is a schematic cross sectional view showing an embodiment of a discharge container in accordance with a second aspect of the present invention, and FIGS. 9A to 9C are schematic views showing an operation of a pump portion in accordance with the embodiment of the second aspect.

At first, a description will be given of a first embodiment in accordance with a first aspect of the present invention. A discharge container 1 in accordance with the first embodiment is provided, as shown in FIG. 1, with a container 3 filled with a drug solution 2, a cap 3 provided above the container 3 and having an injection nozzle (discharge port) 4, and a pump portion 6 connected to a cap 5 and provided within the container 3, whereby the drug solution 2 within the container 3 is supplied to the cap 5 by the pump portion 6 so as to be injected in a vapor form. The pump portion 6 is provided with a first piston 8 connected to the cap 5 and vertically moving within a cylinder 7, and a second piston 9 arranged within the cylinder 7 so as to oppose to the first piston 8.

The first piston 8 is formed so that a lower end portion in FIG. 1 is liquid-tight with an inner peripheral surface of the cylinder 7, and is connected to the cap 5 so as to protrude from the cylinder 7 and the container 3. Further, a small diameter portion 10 formed so as to have a smaller diameter than an inner diameter of the cylinder 7 is provided in a side surface near the lower end portion of the first piston 8, and an outflow port 11 flowing out the drug solution 2 within the cylinder 7 is provided in the small diameter portion 10. The outflow port 11 extends through an inner portion of the first piston 8 and is communicated with the injection nozzle 4 of the cap 5 via a liquid passage 21. Further, the first piston 8 is urged in a backward moving direction (upward in FIG. 1) by a first spring 12.

The second piston 9 is arranged within the cylinder 7 in such a manner as to oppose to the first piston 8, and is urged to a side of the first piston (upward in FIG. 1) by a second spring 13. Further, an inner diameter of the cylinder 7 at a portion where the second piston 9 is arranged is formed so as to be larger than an inner diameter of a portion where the first piston 8 is arranged, and a front end portion of the second piston 9 is brought into contact with a step portion 14 having different inner diameters. Further, an inflow port 15 extending in a vertical direction is provided in a center of the second piston 9, and a check ball 16 is provided as an inflow valve for passing through the drug solution 2 sucked from the below and preventing the drug solution 2 from passing therethrough from the above, in the inflow port 15. Further, a tube 17 extended to a bottom surface of the container 3 is connected to a lower portion of the inflow port 15.

Next, a description will be given of an operation at a time of discharging the drug solution 2 by the discharge container 1 in accordance with the first embodiment with reference to FIGS. 2A to 2D. When the user presses down the cap 5, the first piston 8 moves downward while the first spring 12 is pressed and compressed. At this time, the drug solution 2 is charged within the cylinder 7, however, the outflow port 11 is closed, so that the inflow port 15 is also closed by the check ball 16. At this time, when the first piston 8 moves downward, the second piston 9 is pressed downward by the drug solution existing between the first piston 8 and the second piston 9, whereby the second spring 13 is pressed and compressed. Then, as shown in FIG. 2B, the second piston 9 moved downward accompanying with the downward movement of the first piston 8 until the lower end portion of the first piston 8 reaches the step portion 14. As mentioned above, in accordance with the discharge container 1 in accordance with the first embodiment, the drug solution 2 is not discharged in a stroke from a state that the first piston 8 is at the uppermost position to a state that the lower end portion of the first piston 8 reaches the step portion 14 of the cylinder 7.

Further, as shown in FIG. 2C, when the front end portion of the first piston 8 passes through the step portion 14 and the small diameter portion 10 of the first piston 8 reaches the step portion 14, the outflow port 11 provided in the small diameter portion 10 and an inner portion of the cylinder 7 are communicated with each other. Accordingly, as shown in FIG. 2D, the drug solution 2 charged within the cylinder 7 is pressed out by the second piston 9 due to an urging force of the second spring 13 so as to flow out from the outflow port 11, thereby being discharged in a vapor form from the injection nozzle 4 via the liquid passage 21. At this time, since the drug solution 2 is discharged by a uniform force due to the urging force of the second spring 13, in the case of the discharge container 1 discharging the drug solution 2 in a vapor form as in the present embodiment, it is possible to always obtain a fixed injection state. Further, since a vertical movement of the cap 5 at a time when the drug solution 2 is discharged is a little, the user can accurately inject the drug solution 2 to an optional position.

Further, when the user takes off the hand from the cap 5, the first piston 8 is pressed back upward by the first spring 12, and when the small diameter portion 10 of the first piston 8 passes through the step portion 14, the outflow port 11 is closed. When the first piston 8 is further pressed back from this state, the drug solution 2 is sucked into the cylinder 7 from the inflow port 15 so as to be charged as shown in FIG. 2A.

Next, a description will be given of a discharge container in accordance with a second embodiment of the first aspect of the present invention. In this case, in this second embodiment, a description will be given of only a structure and an operation of the pump portion 6. The pump portion 6 in accordance with the second embodiment has a double-structure comprising an outer cylinder 7*a* and an inner cylinder 7*b*, as shown in FIG. 3. The outer cylinder 7*a* is structured such that a portion to which the drug solution 2 is charged is formed in a substantially cylindrical shape, and a cylindrical first piston 8 is provided therewithin in such a manner as to freely slide in a vertical direction. The first piston 8 is urged upward by the first spring 12 provided below the same. Further, the first piston 8 is structured such that a front end portion 8*a* is slidably in contact with an inner peripheral surface of the outer cylinder 7*a* and an outer peripheral surface of the inner cylinder 7*b*, an upper portion of the front end portion 8*a* is provided with an interval with respect to the inner cylinder 7*b*, and the liquid passage 21 for passing the drug solution 2 therethrough is provided between the inner peripheral surface of the first piston 8 and the outer peripheral surface of the inner cylinder 7*b*. The liquid passage 21 is further structured such that an upper portion thereof is communicated with the injection nozzle 4 provided in the cap 5. Further, the inner cylinder 7*b* is provided in a center portion of the outer cylinder 7*a*, and the second piston 9 is provided therewithin in such a manner as to freely slide in a vertical direction. The second piston 9 is urged downward by the second spring 13. Further, the outer peripheral portion of the lower end of the inner cylinder 7*b* and the outer cylinder 7*a* are communicated with each other by the outflow port 11, the inflow port 15 is provided in a center portion of the lower end of the inner cylinder 7*b*, and the check ball 16 is arranged in the inflow port 15.

Next, a description will be given of an operation at a time of discharging the drug solution 2 by the discharge container in accordance with the second embodiment with reference to FIGS. 3A to 3C. When the user presses down the cap, the first piston 8 moves downward while the first spring 12 is pressed and compressed. Accordingly, since a pressure is applied to the drug solution 2 within the outer cylinder 7*a*, the drug solution 2 flows into the inner cylinder 7*b* via the outflow port 11. Then, the second piston 9 within the inner cylinder 7*b* is pressed upward and the second spring 13 is pressed and compressed. Further, as shown in FIG. 3B, the second piston moved upward accompanying with the downward movement of the first piston 8 until the lower end portion 8*a* of the first piston 8 reaches the outflow port 11. As mentioned above, in accordance with the discharge container in accordance with the second embodiment, the drug solution 2 is not discharged in a stroke from a state that the first piston 8 is at the uppermost position to a state that the front end portion 8*a* of the first piston 8 reaches the outflow port 11.

Further, when the front end portion of the first piston 8 passes through the outflow port 11, the outflow port 11 and the liquid passage 21 within the first piston 8 are communicated with each other, as shown in FIG. 3C. Accordingly, the drug solution 2 charged within the inner cylinder 7*b* is pressed out by the second piston 9 due to an urging force of the second spring 13 so as to flow out from the outflow port 11, thereby being discharged from the injection nozzle 4 through the liquid passage 21. In accordance with the discharge container of the second embodiment, since the drug solution 2 is discharged by a uniform force due to the urging force of the second spring 13, it is possible to discharge the drug solution 2 in a stable state.

Next, a description will be given of a discharge container in accordance with a third embodiment of the first aspect of the present invention. In this case, in this third embodiment, a description will be also given of only a structure and an operation of the pump portion 6. The pump portion 6 in accordance with the third embodiment has a double-structure comprising an outer cylinder 7*a* and an inner cylinder 7*b,* as shown in FIG. 4. The outer cylinder 7*a* is structured such that a portion to which the drug solution 2 is charged is formed in a substantially cylindrical shape, and a ring-shaped second piston 9 is provided therewithin so as to be urged downward by the second spring 13 and freely slide in a vertical direction. The inner cylinder 7*b* is communicated with the outer cylinder 7*a* in a communication portion 18 at a lower end thereof, and the first piston 8 is slidably provided therewithin. The first piston 8 is structured such that the small diameter portion 10 formed so as to have a smaller diameter than an inner diameter of the inner cylinder 7*b* is provided on a side surface near the lower end portion thereof, in the same manner as that of the first embodiment, and the outflow port 11 for flowing out the drug solution 2 within the cylinder 7 is provided in the small diameter portion 10. The outflow port 11 is communicated with the injection nozzle 4 of the cap 5 via the liquid passage 21 extending through the inner portion of the first piston 8. Further, the first piston 8 is urged in a backward moving direction (upward in FIG. 4) by the first spring 12 (not shown). Further, the inflow port 15 provided with the check ball 16 is provided below the inner cylinder 7*b,* and a tube 17 extended to the bottom surface of the container 3 is connected to the lower portion of the inflow port 15.

Next, a description will be given of an operation at a time of discharging the drug solution 2 by the discharge container in accordance with the third embodiment with reference to FIGS. 4A to 4C. When the user presses down the cap, the first piston 8 moves downward while the first spring 12 is pressed and compressed. At this time, the drug solution 2 is charged within the inner cylinder 7*b,* however, the outflow port 11 is closed, so that the inflow port 15 is also closed by the check ball 16. At this time, when the first piston 8 moves downward, the second piston 9 within the outer cylinder 7*a* is pressed upward by the drug solution 2 existing within inner cylinder 7*b,* whereby the second spring 13 is pressed and compressed. Then, as shown in FIG. 4B, the second piston 9 moved upward accompanying with the downward movement of the first piston 8 until the lower end portion of the first piston 8 reaches the lower end portion of the inner cylinder 7*b.* As mentioned above, in accordance with the discharge container in accordance with the third embodiment, the drug solution 2 is not discharged in a stroke from a state that the first piston 8 is at the uppermost position to a state that the lower end portion of the first piston 8 reaches the lower end portion of the inner cylinder 7*b.*

Further, when the front end portion of the first piston 8 passes through the lower end portion of the inner cylinder 7*b,* the communication portion 18 between the inner cylinder 7*b* and the outer cylinder 7*a* is communicated with the outflow port 11, as shown in FIG. 4C. Accordingly, the drug solution 2 charged within the outer cylinder 7*a* is pressed out by the second piston 9 due to an urging force of the second spring 13 so as to flow out from the outflow port 11, thereby being discharged from the injection nozzle 4 through the liquid passage 21. In accordance with the discharge container of the third embodiment, since the drug solution 2 is discharged by a uniform force due to the urging force of the second spring 13, it is possible to discharge the drug solution 2 in a stable state.

Next, a description will be given of a discharge container in accordance with a fourth embodiment of the first aspect of the present invention. In this case, in this fourth embodiment, a description will be also given of only a structure and an operation of the pump portion 6. The pump portion 6 in accordance with the fourth embodiment is structured, as shown in FIG. 5, such that the substantially cylindrical second piston 9 is slidably provided within the cylinder 7, and the first piston 8 is slidably provided within the second piston 9.

The first piston 8 is upward urged by the first spring (not shown). The first piston 8 is formed so as to have a smaller diameter than that of the inner peripheral surface of the second piston 9 except the front end portion, and the liquid passage 21 formed between the inner peripheral portion of the second piston 9 and the outer peripheral portion of the first piston 8 is connected to the injection nozzle 4 provided in the cap. In this fourth embodiment, the structure is made such that the first piston 8 is pressed downward, whereby the second piston 9 is pressed upward and the outflow port 11 is opened when the front end portion of the first piston 8 passes through the front end portion of the second piston 9 (refer to FIG. 5C).

The second piston 9 is formed so as to have a smaller diameter than that of the cylinder 7 except the flange portion 9*a* provided in the front end thereof, and the second spring 13 is provided between the outer peripheral portion of the second piston 9 and the inner peripheral portion of the cylinder 7. The second spring 13 presses the flange portion 9*a* downward, thereby urging the second piston 9 downward. Accordingly, the flange portion 9*a* is brought into contact with the bottom surface portion of the cylinder 7, however, since a recess inserted portion 22 formed so as to have a larger diameter than the inner diameter of the second piston 9 is formed in the bottom surface portion, the lower end portion of the second piston 9 is in contact with the drug solution 2. Further, the inflow port 15 provided with the check ball 16 is provided below the cylinder 7, and the tube 17 extended to the bottom surface of the container 3 is connected to the lower portion of the inflow port 15.

Next, a description will be given of an operation at a time of discharging the drug solution 2 by the discharge container in accordance with the fourth embodiment with reference to FIGS. 5A to 5C. When the user presses down the cap 5, the first piston 8 moves downward while the first spring (not shown) is pressed and compressed. Accordingly, since a pressure is applied to the drug solution 2 within the cylinder 7 and the pressure is also applied to the lower end portion of the piston 9, the second piston 9 is pressed upward while pressing and compressing the second spring 13. Then, as shown in FIG. 5B, since the outflow port 11 is not open in a stroke from a state until the front end portion of the first piston 8 reaches the front end portion of the second piston 9, the drug solution 2 is not discharged.

Further, as shown in FIG. 5C, when the front end portion of the first piston 8 passes through the front end portion of the second piston 9, the outflow port 11 formed by the front end portion of the first piston and the front end portion of the second piston 9 is open, so that the drug solution 2 is discharged from the injection nozzle 4 of the cap via the liquid passage 21 formed between the first piston 8 and the second piston 9 from the outflow port 11. In this case, the urging force of the second spring 13 is applied to the first piston 8 until the front end portion of the first piston 8 reaches the front end portion of the second piston 9, however, when the outflow port 11 is open, the urging force of the second spring 13 is not applied to the first piston 8, so that the first piston is pressed down to the bottom surface portion as it is. Further, thereafter, the second piston 9 is pressed down by the urging force of the second spring 13, and the drug solution 2 is discharged. As mentioned above, in accordance with the discharge container of the fourth embodiment, since the drug solution 2 is discharged by a uniform force due to the urging force of the second spring 13, it is possible to discharge the drug solution 2 in a stable state.

Next, a description will be given of a discharge container 1*a* in accordance with a fifth embodiment of the first aspect of the present invention with reference to FIGS. 6 and 7. The discharge container 1*a* in accordance with the fifth embodiment is structured, as shown in FIG. 6, such that the pump portion 6 is provided above the container 3, and the drug solution 2 is injected in a vapor form upward from the injection nozzle 4 by pressing leftward a lever 23 connected to the first piston 8 in a left side in FIG. 6. As mentioned above, in the discharge container 1*a* in accordance with the fifth embodiment, as shown in FIG. 6, a moving direction of the first piston 8 and an injecting direction of the drug solution 2 form a substantial right angle. The pump portion 6 in accordance with the fifth embodiment is provided with the first piston 8 slidably provided within the cylinder 7, and the second piston slidably provided within the cylinder so as to oppose to the first piston 8.

The first piston 8 is urged rightward by the first spring (not shown). The second piston 9 is formed in a substantially cylindrical shape, and is urged to a right side by the second spring 13 provided in a left side thereof. Further, the inflow port 15 having the check ball 16 is provided in a center portion of the second piston 9, and the tube 17 extended to the bottom surface of the container 3 toward the lower portion is connected to the left side of the inflow port 15. The outflow port 11 is provided above the cylinder 7, and is open toward a part of a stroke of the second piston 9, as shown in FIGS. 7A to 7B. In particular, the structure is made such as to be closed by the side surface of the second piston 9 when the second piston 9 is positioned at a right side and be opened when the second piston 9 is positioned at a leftmost side. Further, the outflow port 11 is communicated with the injection nozzle 4 via the liquid passage (not shown).

Next, a description will be given of an operation at a time of discharging the drug solution 2 by the discharge container 1*a* in accordance with the fifth embodiment with reference to FIGS. 7A to 7C. When the user presses the lever 23 to the left side, the first piston 8 moves leftward while the first spring (not shown) is pressed and compressed. Accordingly, since a pressure is applied to the drug solution 2 within the cylinder 7 and the pressure is applied to the second piston 9, the second piston 9 moves leftward while pressing and compressing the second spring 13. Further, since the outflow port 11 is not open in a stroke from a state until the front end portion of the second piston 9 reaches the outflow port 11, the drug solution 2 is not discharged.

Further, as shown in FIG. 7C, when the front end portion of the second piston 9 passes through the outflow port 11, the outflow port 11 and the inner portion of the cylinder 7 are communicated with each other, so that the drug solution 2 flows out from the outflow port 11 so as to be discharged from the injection nozzle 4 of the cap via the liquid passage (not shown). In accordance with the fifth embodiment, since the outflow port 11 is provided in the cylinder 7 and the structure is made such that the first piston 8 is moved without moving the cylinder 7, the outflow port 11 and the injection nozzle 4 do not move. Accordingly, in the case of injecting the drug solution 2 in a vapor form as in the discharge container 1*a* in accordance with the present embodiment, the user can inject the drug solution 2 to the accurate position.

Next, a description will be given of a discharge container 1*b* in accordance with a second aspect of the present invention. The discharge container 1*b* in accordance with the second aspect is, as shown in FIG. 8, provided with a container 3 filled with a drug solution 2, and a pump portion 6 provided above the container 3, whereby the drug solution 2 within the container 3 is injected in a vapor form by the pump portion 6.

The pump portion 6 is provided with a cylinder 7 integrally moving with a cap 5 in a vertical direction, a first piston 8 arranged below the cylinder 7 and fixed to a pump case 3*a,* and a second piston 9 arranged above the cylinder 7 so as to oppose to the first piston 8. Further, an outflow valve 11*a* is provided so as to surround a periphery of the second piston 9 from a side surface of the second piston 9 toward the above, and this outflow valve 11*a* is communicated with an injection nozzle 4 protruding outward from a side surface of the cap 5 via a liquid passage 21. Further, a gap holding member 31 for keeping a gap between the first piston 8 and the second piston 9 is held between the first piston 8 and the second piston 9 within the cylinder 7 in an inclined state.

The cylinder 7 is provided with a reduced diameter portion 7*c* in which a diameter is reduced from a lower portion to an upper portion thereof, on an inner peripheral surface thereof, as shown in FIG. 8. Further, a first spring 12 arranged between the cylinder 7 and the first piston 8 via the gap holding member 31 and urging the cylinder 7 upward is provided within the cylinder 7 disposed below the reduced diameter portion 7*c*.

The first piston 8 is formed in a substantially cylindrical shape as shown in FIG. 8, and an inflow port 15 is provided in a center portion. Further, a check ball 16 is provided as an inflow valve for passing the liquid supplied from the below and shutting the liquid supplied from the above, in the inflow port 15. Further, a tube 17 for sucking the drug solution 2 from the bottom portion of the container 3 is connected to the lower end portion of the first piston 8.

A column-shaped recess portion 9*b* to which a column portion 31*a* of the gap holding member 31 mentioned below is inserted is provided in the second piston 9. Further, the second piston 9 is urged downward via the outflow valve 11*a* by a second spring 13 brought into contact with a rear end portion of the cylinder 7, as shown in FIG. 8. The second piston 9 is brought into contact with an upper surface of the reduced diameter portion 7*c* of the cylinder 7 in a state that the cap 5 is not pressed and at an upper position. The outflow valve 11*a* is formed by a flexible member such as a silicon rubber or the like, and is arranged so as to surround a periphery of the second piston 9. The outflow valve 11*a* moves apart from the second piston 9 when the pressure is applied thereto from the below by the drug solution 2, whereby a gap is formed between the outflow valve 11*a* and the second piston 9 and the outflow port 11 is opened. Then, the drug solution 2 flows out from the outflow port 11. On the contrary, when the pressure of the liquid is lost within the cylinder 7, the outflow valve 11*a* is brought into contact with the second piston 9, so that the outflow port 11 is closed, and the inner portion of the cylinder 7 and the injection nozzle 4 are shut.

The gap holding member 31 is structured, as shown in FIG. 8, such that the column portion 31*a* is formed in a front end portion thereof, and an inclined portion 31*b* is formed below the column portion 31*a*. Further, a flange portion 31*c* is provided in a lower end portion thereof, and the first spring 12 is brought into contact with the flange portion 31*c*. The first spring 12 is formed so that a left side in FIG. 8 is long and a right side is short, and holds the gap holding member 31 in an inclined manner in the case that the cap 5 is not pressed.

Next, a description will be given of an operation at a time of discharging the drug solution 2 by the discharge container 1*b* in accordance with the second aspect with reference to FIGS. 9A to 9C. When the user presses down the cap 5, the cylinder 7 integrally formed with the cap 5 is moved downward. At this time, the reduced diameter portion 7*c* moves downward while pressing and compressing the first spring 12, however, accompanying with this motion, the column portion 31*a* of the gap holding member 31 brought into contact with the inclined surface of the reduced diameter portion 7*c* is taken off from the reduced diameter portion 7*c* so as to be brought into contact with the lower end portion of the second piston 9. When the cylinder 7 is further pressed down, the second piston 9 is held by the gap holding member 31 as shown in FIG. 9B, so that the rear end portion of the cylinder 7 is pressed down, whereby the second spring 13 is pressed and compressed. When the cylinder 7 is further pressed down, the inclined portion 31*b* of the gap holding member 31 is brought into contact with the inclined surface of the reduced diameter portion 7*c*, so that an angle of inclined of the gap holding member 31 is reduced in correspondence to a downward movement of the cylinder 7. At this time, the first spring 12 and the second spring 13 are pressed and compressed in correspondence to the downward movement of the cylinder 7, however, since the gap between the first piston 8 and the second piston 9 is kept by the gap holding member 31, no pressure is applied to the drug solution 2 charged within the cylinder 7 between the both. Accordingly, since the outflow valve 11*a* is in a closed state, no drug solution 2 flows out from the outflow port 11.

Further, when the gap holding member 31 becomes in a perpendicularly erect state, the column portion 31*a* of the gap holding member 31 is inserted to the recess portion 9*b* of the second piston 9. Accordingly, the gap between the first piston 8 and the second piston 9 is reduced at a distance that the column portion 31*a* of the gap holding member 31 is inserted to the recess portion 9*b* of the second piston 9. In this case, since the second piston 9 is urged in a direction of the first piston 8 by the second spring 13, a pressure is applied to the drug solution 2 charged between the first piston 8 and the second piston 9 by the second piston 9. Accordingly, the outflow valve 11*a* is opened, and the drug solution 2 flows out from the outflow port 11 and is injected from the injection nozzle 4 via the liquid passage 21. In this discharge container 1*b* in accordance with the second aspect, since the drug solution 2 is also discharged by a uniform force due to the urging force of the second spring 13, it is possible to discharge the drug solution 2 in a stable state.

In this case, in the first embodiment to the fifth embodiment in accordance with the first aspect of the present invention, the liquid 2 is discharged by moving the piston 8 within the cylinder 7. Further, in the embodiment in accordance with the second aspect of the present invention, the liquid 2 is discharged by moving the cylinder 7. As mentioned above, since the motion is relative to each other between the piston and the cylinder, in each of the embodiments in accordance with the first aspect, the structure may be modified such as to move the cylinder 7, and in the embodiment in accordance with the second aspect, the structure may be modified such as to move the piston 8.

Industrial Applicability

As described above, the present invention is applicable to a discharge container which receives a liquid such as a drug solution or the like, and discharges the liquid on the basis of a pump operation.

What is claimed is:

1. A discharge container for discharging a liquid received within a container to an external portion from a discharge port on the basis of a pump operation comprising:

a cylinder within which a liquid is charged;

a first piston slidably provided within said cylinder and urged in a backward moving direction by a first spring;

a second piston slidably provided within said cylinder and backward moving while compressing a second spring when the liquid within said cylinder is pressed by said first piston;

an inflow port for flowing the liquid from the inner portion of said container to an inner portion of said cylinder;

an inflow valve provided between said inflow port and said container, passing the liquid flowing into said cylinder and shutting an outflow of the liquid from the inner portion of said cylinder;

an outflow port for flowing the liquid to the external portion from the inner portion of said cylinder; and a liquid passage connecting said outflow port to said discharge port, wherein said cylinder has a small diameter portion having a small inner diameter, a large diameter portion k having a large inner diameter and a step portion corresponding to a boundary therebetween, said first piston is provided within said small diameter portion, said second piston is provided within said large diameter portion so as to oppose to said first piston, said outflow port is formed near a front end portion of said first piston so as to direct to a sliding surface with said cylinder, said liquid passage is connected to said discharge port through said first piston, said inflow port is provided so as to pass through said second piston, said first piston is urged in a direction moving apart from said second piston by said first spring, said second piston is urged by said second spring so as to be brought into contact with said step portion, wherein while said first piston moves at a predetermined stroke, said outflow port is closed, and said second piston moves backward while pressing and compressing said second spring by the liquid existing between said first piston and said second piston, and wherein when said first piston moves over the predetermined stroke, said outflow port is opened, said second piston is pressed back to said second spring and the liquid within said cylinder is discharged to the external portion via said outflow port, said liquid passage and said discharge port due to an urging force of said second spring.

2. A discharge container for discharging a liquid received within a container to an external portion from a discharge port on the basis of a pump operation comprising:

a cylinder within which a liquid is charged;

a first piston slidably provided within said cylinder and urged in a backward moving direction by a first spring;

a second piston slidably provided within said cylinder and backward moving while compressing a second spring when the liquid within said cylinder is pressed by said first piston; an inflow port for flowing the liquid from the inner portion of said container to an inner portion of said cylinder;

an inflow valve provided between said inflow port and said container, passing the liquid flowing into said cylinder and shutting an outflow of the liquid from the inner portion of said cylinder;

an outflow port for flowing the liquid to the external portion from the inner portion of said cylinder; and a liquid passage connecting said outflow port to said discharge port, wherein said cylinder is constituted by an outer cylinder formed in a cylindrical body having a bottom, and an inner cylinder provided within said outer cylinder and having a bottom portion communicated with said outer cylinder via a communication portion, said first piston is formed in a cylindrical shape and outward fitted to said inner cylinder, a lower end portion of said first piston is slidably in contact with an inner peripheral surface of said outer cylinder and an outer peripheral surface of said inner cylinder, said second piston is provided within said inner cylinder, said liquid passage is formed in a gap between an inner peripheral surface above the lower end portion of said first piston and the outer peripheral surface of said inner cylinder, said outflow port is formed between the inner peripheral surface of said first piston and said communication portion in a state that the lower end portion of said first piston passes through said communication portion, said inflow port is provided in the bottom portion of said inner cylinder, said first piston is urged in a direction moving apart from the bottom portion of said outer cylinder by said first spring, said second piston is urged toward the bottom portion of said inner cylinder by said second spring, and wherein when said first piston moves over the predetermined stroke, the lower end portion of said first piston moves over said communication portion and said outflow port is opened, and said second piston is pressed back to said second spring and the liquid within said cylinder is discharged to the external portion via said outflow port, said liquid passage and said discharge port due to an urging force of said second spring.

3. A discharge container for discharging a liquid received within a container to an external portion from a discharge port on the basis of a pump a pump operation comprising:

a cylinder within which a liquid is charged;

a first piston slidably provided within said cylinder and urged in a backward moving direction by a first spring;

a second piston slidably provided within said cylinder and backward moving while compressing a second spring when the liquid within said cylinder is pressed by said first piston;

an inflow port for flowing the liquid from the inner portion of said container to an inner portion of said cylinder;

an inflow valve provided between said inflow port and said container, passing the liquid flowing into said cylinder and shutting an outflow of the liquid from the inner portion of said cylinder;

an outflow port for flowing the liquid to the eternal portion from the inner portion of said cylinder; and a liquid passage connecting said outflow port to said discharge port, wherein said cylinder is constituted by an outer cylinder formed in a cylindrical body having a bottom, and an inner cylinder formed on an inner peripheral surface of a cylindrical second piston provided within said outer cylinder, said second piston is slidably in contact with an inner peripheral surface of said outer cylinder and having a bottom surface portion facing to the liquid within said cylinder, said first piston is provided within said inner cylinder, a lower end portion of said first piston is slidably in contact with an inner peripheral surface of said inner cylinder toward a bottom surface of said outer cylinder, said liquid passage is formed above said lower end portion with a gap with respect to the inner peripheral surface of said inner cylinder, said outflow port is formed between the bottom surface portion of said second piston and the lower end portion of said first piston in a state that the lower end portion of said first piston protrudes out from the bottom surface portion of said second piston, said inflow port is provided in the bottom surface of said outer cylinder, said first piston is urged in a direction moving apart from the bottom portion of said outer cylinder by said first spring, said second piston is urged toward the bottom portion of said outer cylinder, and wherein when said first piston moves over the predetermined stroke, the lower end portion of said first piston moves over the bottom surface portion of said second piston and said outflow port is opened, and said second piston is pressed back to said second spring and the liquid within said cylinder is discharged to the external portion via said outflow port, said liquid passage and said discharge port due to an urging force of said second spring.

4. A discharge container for discharging a liquid received within a container to an external portion from a discharge port on the basis of a pump operation comprising:

a cylinder within which a liquid is charged;

a first piston slidably provided within said cylinder and urged in a backward moving direction by a first spring;

a second piston slidably provided within said cylinder and backward moving while compressing a second spring when the liquid within said cylinder is pressed by said first piston;

an inflow port for flowing the liquid from the inner portion of said container to an inner portion of said cylinder;

an inflow valve provided between said inflow port and said container, passing the liquid flowing into said cylinder and shutting an outflow of the liquid from the inner portion of said cylinder;

an outflow port for flowing the liquid to the external portion from the inner portion of said cylinder; and a liquid passage connecting said outflow port to said discharge port, wherein said cylinder is formed in a cylindrical shape, said first piston and said second piston are provided within said cylinder so as to oppose to each other, said outflow port is open to a side surface of said cylinder corresponding to a part of a stroke of said second piston, said inflow port is provided so as to extend through said second piston, said first piston is urged in a direction moving apart from said second piston by said first spring, said second piston is urged toward said first piston by said second spring, and wherein while said first piston moves to the predetermined stroke, said outflow port is closed by a side surface of said second piston, and when said first piston moves over the predetermined stroke, said second piston is pressed, an end portion in a side of said first piston moves over said outflow port and said outflow port is opened, and said second piston is pressed back to said second spring and the liquid within said cylinder is discharged to the external portion via said outflow port, said liquid passage and said discharge port due to an urging force of said second spring.

5. A discharge container for discharging a liquid received within a container to an external portion from a discharge port on the basis of a pump operation comprising:

a case with a bottom held in said container;

a first piston provided on a bottom surface of said case;

a cylinder outward fitted to the first piston within said case and filled with a liquid therewithin;

a second piston provided within said cylinder with a predetermined gap with respect to said first piston;

a first spring urging said cylinder upward;

a second spring urging said second piston to a side of said first piston;

an inflow port extending through said first piston so as to flow the liquid from said container into said cylinder;

an inflow valve provided between said inflow port and said container so as to pass the liquid flowing into said cylinder and prevent the liquid from flowing out from the inner portion of said cylinder;

an outflow valve urged to an upper surface of said second piston by said second spring so as to be brought into contact therewith, having an outer peripheral portion protruding from an outer peripheral edge of said second piston so as to be slidably brought into contact with an inner peripheral surface of said cylinder and having a portion protruding out from the outer peripheral edge of said second piston and facing to the liquid within said cylinder;

an outflow port formed in a contact portion between said outflow valve and said second piston and flowing out the liquid to an external portion from an inner portion of said cylinder;

a liquid passage connecting said outflow port to said discharge port; and a gap holding member arranged between an upper surface of said first piston and a lower surface of said second piston so as to keep a gap between the both, wherein a recess portion to which said gap holding member can be inserted in a moving direction at a predetermined distance is provided on a surface of said second piston opposing to said first piston, and a guide portion for guiding said gap holding member to said recess portion when said cylinder is pressed down is provided in said cylinder, wherein said gap holding member is held by said first spring in a state of being out of said recess portion when said cylinder is not pressed down, wherein when pressing downward said cylinder to the predetermined stroke, said gap holding member is brought into contact with said first piston and said second piston in a state of being out of said recess portion so as to press and compress said second spring while keeping a gap between the both, and wherein when pressing down said cylinder over the predetermined stroke, said gap holding member is guided by said guiding member so as to be inserted to said recess portion, and said gap holding member press down said second piston downward at a distance that said gap holding member is inserted to said recess portion by said second spring, thereby applying a pressure to the liquid within said cylinder, so that said second spring is pressed and compressed by the pressure of said liquid, said outflow valve is opened so as to open said outflow port, and the liquid is flowed out to the external portion via said outflow port, said liquid passage and said discharge port.

* * * * *